US012696944B2

(12) United States Patent
Harris et al.

(10) Patent No.: US 12,696,944 B2
(45) Date of Patent: Aug. 4, 2026

(54) GLOVE WITH EXTERNAL SEAM PORTION

(71) Applicant: LION GROUP, INC., Dayton, OH (US)

(72) Inventors: Richard H. Harris, Beavercreek, OH (US); Liberty Malenich, Kettering, OH (US)

(73) Assignee: LION GROUP, INC., Dayton, OH (US)

( * ) Notice: Subject to any disclaimer, the term of this patent is extended or adjusted under 35 U.S.C. 154(b) by 114 days.

(21) Appl. No.: 17/878,474

(22) Filed: Aug. 1, 2022

(65) Prior Publication Data

US 2023/0030732 A1 Feb. 2, 2023

Related U.S. Application Data

(60) Provisional application No. 63/227,629, filed on Jul. 30, 2021.

(51) Int. Cl.
*A41D 19/00* (2006.01)

(52) U.S. Cl.
CPC ..... *A41D 19/00* (2013.01)

(58) Field of Classification Search
CPC ..... A41D 13/087; A41D 19/015; A41H 43/04
USPC ..... 2/65, 167; 112/475.08, 0.09
See application file for complete search history.

(56) References Cited

U.S. PATENT DOCUMENTS 747,169 A * 12/1903 Hallock ..... A41D 19/00 2/165
1,377,338 A * 5/1921 Grinnell ..... A41D 19/02 2/169
1,538,262 A * 5/1925 Ackerman ..... A41D 19/001 2/169
1,641,701 A * 9/1927 Spivak ..... A41D 19/015 2/169
1,885,446 A * 11/1932 Johanson ..... A41D 19/02 66/174
2,723,399 A * 11/1955 Waller ..... A41D 19/0003 2/165
3,151,334 A * 10/1964 Haupt ..... A41D 19/015 2/165
3,251,067 A * 5/1966 Shmikler ..... A41D 19/02 2/169
3,739,400 A * 6/1973 Colehower ..... A41D 19/015 2/161.6
4,123,803 A * 11/1978 Rinehart ..... A41D 19/0017 2/163
4,295,228 A 10/1981 Dragomir
4,733,413 A * 3/1988 Dykstra ..... A41D 19/0006 2/164
5,515,548 A 5/1996 Lazarus
7,836,839 B2 11/2010 Park
8,276,214 B2 * 10/2012 Grilliot ..... A41D 19/015 2/163
9,655,393 B2 * 5/2017 Mathews ..... A41D 19/001
(Continued)

FOREIGN PATENT DOCUMENTS

DE 20 2011 106 474 U1 12/2011

*Primary Examiner* — Katherine M Moran
(74) *Attorney, Agent, or Firm* — Thompson Hine LLP

(57) ABSTRACT

A glove including a plurality pieces of material coupled together along a plurality of seams to form a glove. A majority of the seams of the glove, as measured along their length, are not external seams, and a thumb seam extending along or through a palm of the glove is an external seam.

32 Claims, 11 Drawing Sheets

(56) References Cited

U.S. PATENT DOCUMENTS

| | | | | |
|---|---|---|---|---|
| 2007/0000018 | A1* | 1/2007 | Prouty | A41D 19/015<br>2/159 |
| 2010/0242154 | A1* | 9/2010 | Hale | A41D 19/01558<br>2/161.8 |
| 2011/0258751 | A1* | 10/2011 | Matsuoka | A41D 19/02<br>2/159 |
| 2014/0215685 | A1 | 8/2014 | Bush et al. | |

* cited by examiner

GLOVE WITH EXTERNAL SEAM PORTION

This application claims priority to U.S. provisional application Ser. No. 63/227,629, filed on Jul. 30, 2022 and entitled GLOVE WITH EXTERNAL SEAM PORTION, the entire contents of which are hereby incorporated by reference.

This application relates to a protective glove, and more particularly, to a protective glove with an external seam.

BACKGROUND

Protective or hazardous duty gloves are used in a variety of industries and settings to protect the wearer from hazardous conditions such as heat, cold, sharp objects, chemicals, liquids, and the like. The gloves may be made of various portions or pieces of material, and include various seams that couple together the differing portions. However, some seams in certain locations may cause discomfort for the wearer.

SUMMARY

In one embodiment the present invention is a glove including a plurality pieces of material coupled together along a plurality of seams to form a glove. A majority of the seams of the glove, as measured along their length, are not external internal seams, and a thumb seam extending along or through a palm of the glove is an external seam.

DETAILED DESCRIPTION

Figure 2:
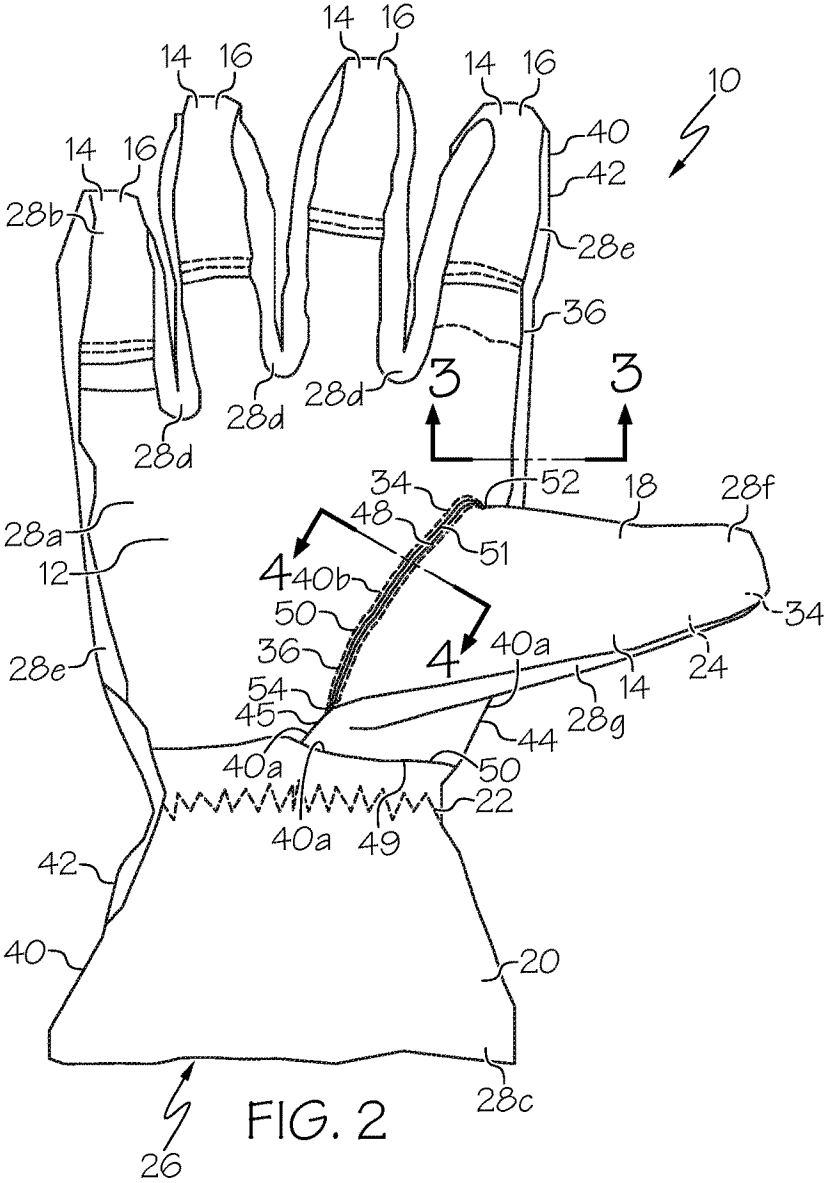
FIG. 2 is a front view of the glove of FIG. 1, with the thumb in an outer position.
Figure 1:
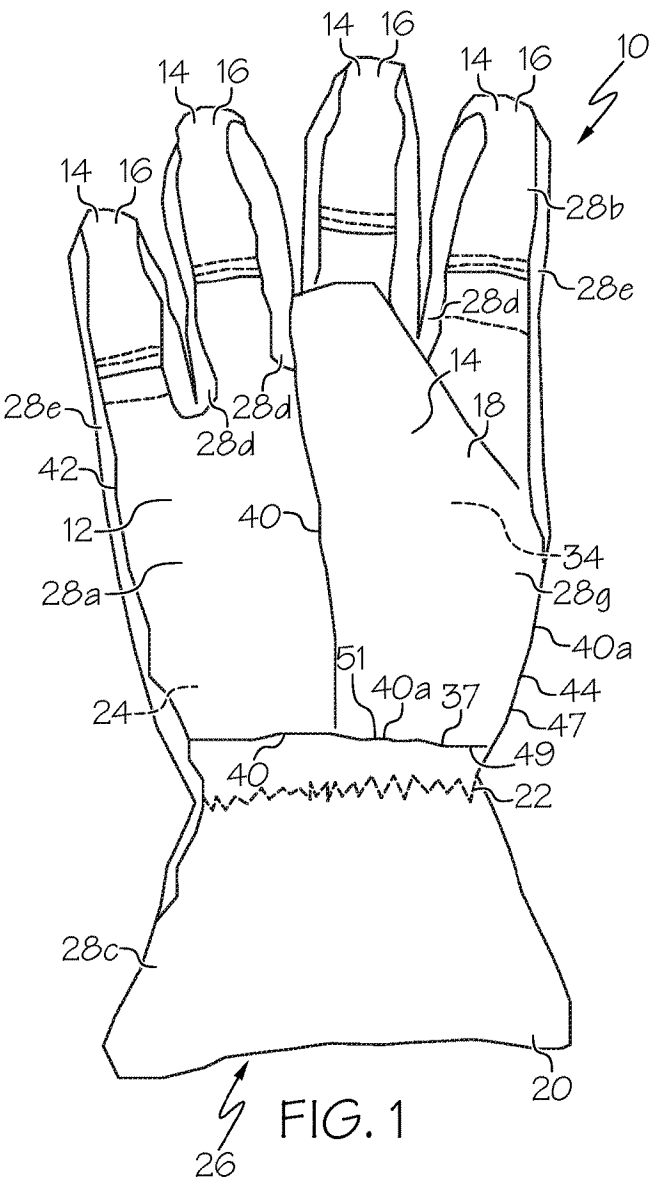
FIG. 1 is a front view of one embodiment of a glove with an external seam, with the thumb in an inner position.

FIGS. 1 and 2 illustrate a protective glove, generally designated 10, that is shaped and configured to closely conform to and receive a wearer's hand therein. The glove 10 includes a generally centrally located palm 12 with five digits 14 extending therefrom in a generally radially outer direction (four fingers 16 and a thumb 18), each shaped and configured to receive a corresponding digit of a wearer's hand therein. The glove 10 includes a wrist or wrist portion 20 located at a lower end thereof and connector to a lower portion of the palm 12. The glove 10/wrist 20 can include an elastic component 22 extending circumferentially about the wrist 20 to engage and potentially form a seal with a wearer's wrist when the glove 10 is worn.

Figure 17:
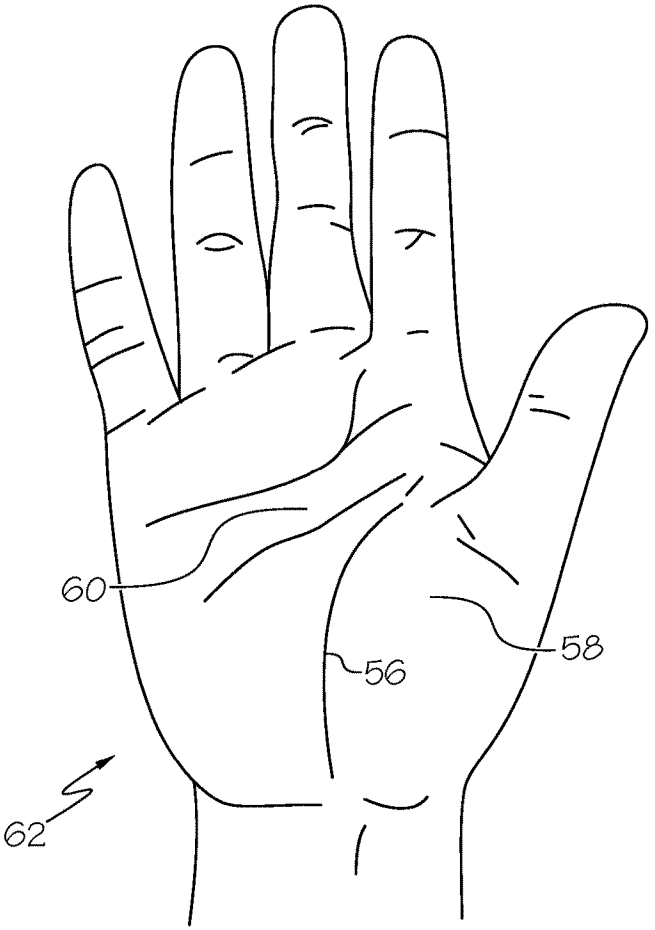
FIG. 17 is a front view of a wearer's hand that can fit into a glove.

The glove 10 includes an inner cavity 24 configured to receive a wearer's hand 62 (FIG. 17) therein, and an access opening 26 located at or adjacent to a lower end of the wrist 20. The access opening 26 is configured to receive the wearer's hand 62 therethrough when the wearer dons the glove 10. FIGS. 1 and 2 (and associated FIGS. 3-16) show a right glove 10 configured to be worn on the right hand 62 of a wearer, and a corresponding manner of assembly/manufacture, but it should be understood that a left glove can be provided and assembled/manufactured having the same pertinent details in a mirror-imaged manner. In addition, the glove(s) 10 can be provided in various sizes, and the pertinent details disclosed herein can remain the same.

The glove 10 can be made of a plurality pieces of material 28 coupled together along a plurality of seams 40 to form the glove 10. Each piece 28 can, in one case, be a piece of material which begins or is formed as a relatively flat, planar material that can be folded, bent and/or joined in the desired manner to form the glove 10. The glove 10/pieces of material 28 can be made of any of a wide variety of materials as desired, such as leather, and/or various fibers or fabrics or polymer materials, including a flame, heat and abrasion resistant material such as a compact weave of aramid fibers and/or polybenzamidazole fibers or a thermostable organic polymer material, a blend of any of the materials listed above, or other appropriate materials.

Figure 7:
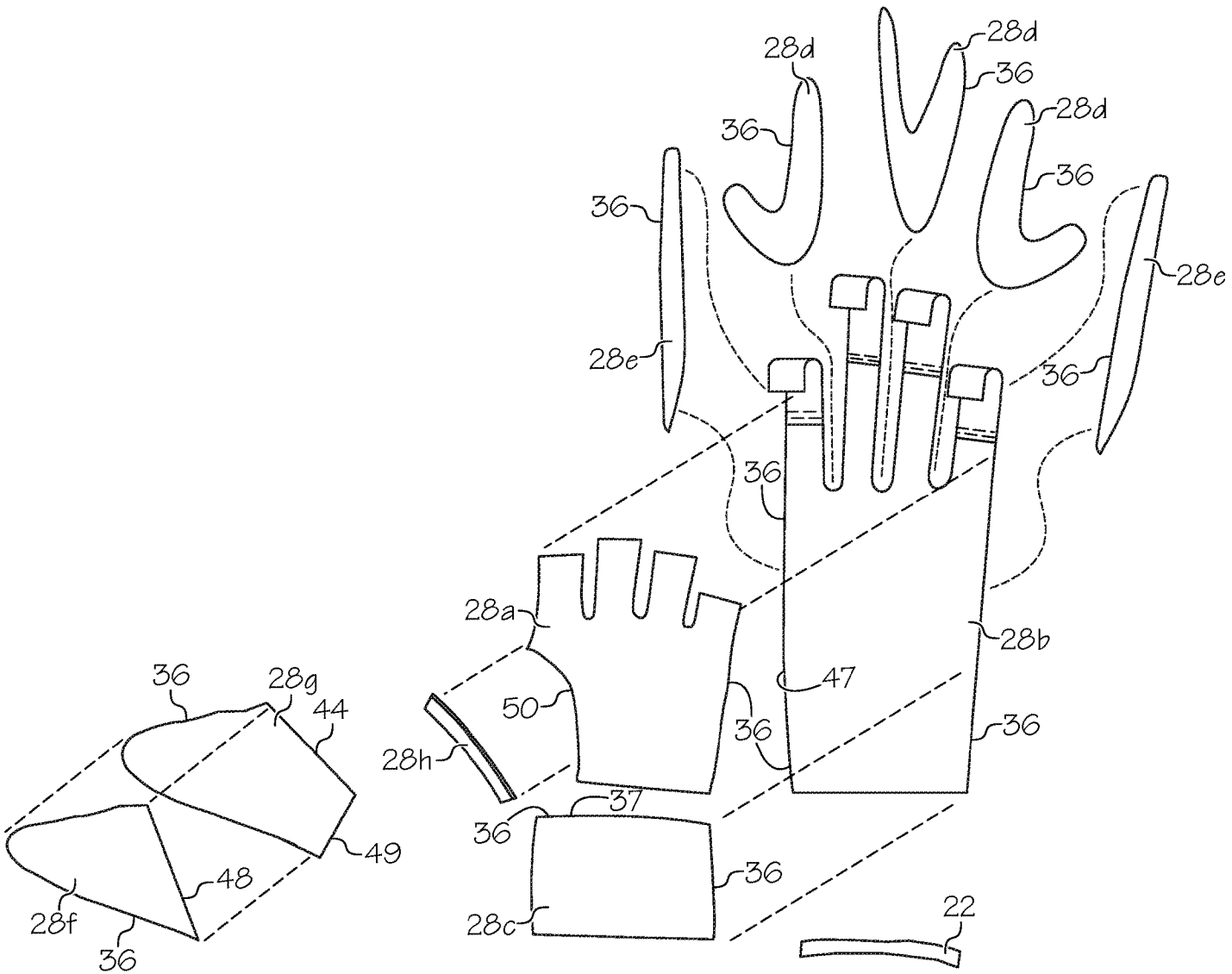
FIG. 7 shows the glove of FIG. 6, in a disassembled state, and a starting point for assembly/manufacture of the glove.

FIG. 7 illustrates one particular embodiment of various starting pieces of material 28 that can be joined to form the glove 10 of FIGS. 1-6. However it should be understood that the glove 10 can be formed from various different pieces of material 28 having different shapes, sizes and configuration from that shown herein. In addition, each piece of material 28 shown in FIG. 7 can itself be made of various sub-pieces which are joined together with seams or otherwise to form the larger pieces of material.

The pieces 28 of FIG. 7 include a palm piece 28*a*, a backing piece 28*b*, a wrist piece 28*c*, a plurality of side finger pieces 28*d*, a pair of side pieces 28*e*, a pair of thumb pieces 28*f*, 28*g*, and an optional thumb insert or piece of reinforcing material 28*h*. In order to form the glove 10, the distal end of the fingers of the backing piece 28*b* are folded/curled forwardly upon themselves as shown in FIG. 7, and the palm piece 28*a* and backing piece 28*b* are coupled together along the left and right side edges (excluding the thumb seam edge 50), and along the end of the finger tips, to form the basic framework of the glove 10. The side finger pieces 28*d* are then folded in the desired manner and coupled to the sides of adjacent fingers of the palm piece 28*a* and backing piece 28*b* to close/form the outer edges of the associated fingers 16. The side pieces 28*e* are then attached along the outer edges of the index finger and little finger of the palm piece 28*a* and backing piece 28*b* to close/form the ends of the index finger and little finger, using the fourchette method for finger construction, in the illustrated embodiment. However the glove 10/fingers 16 can be assembled using differing methods and pieces 28 from that shown, including gunn cut construction/assembly.

Figure 8:
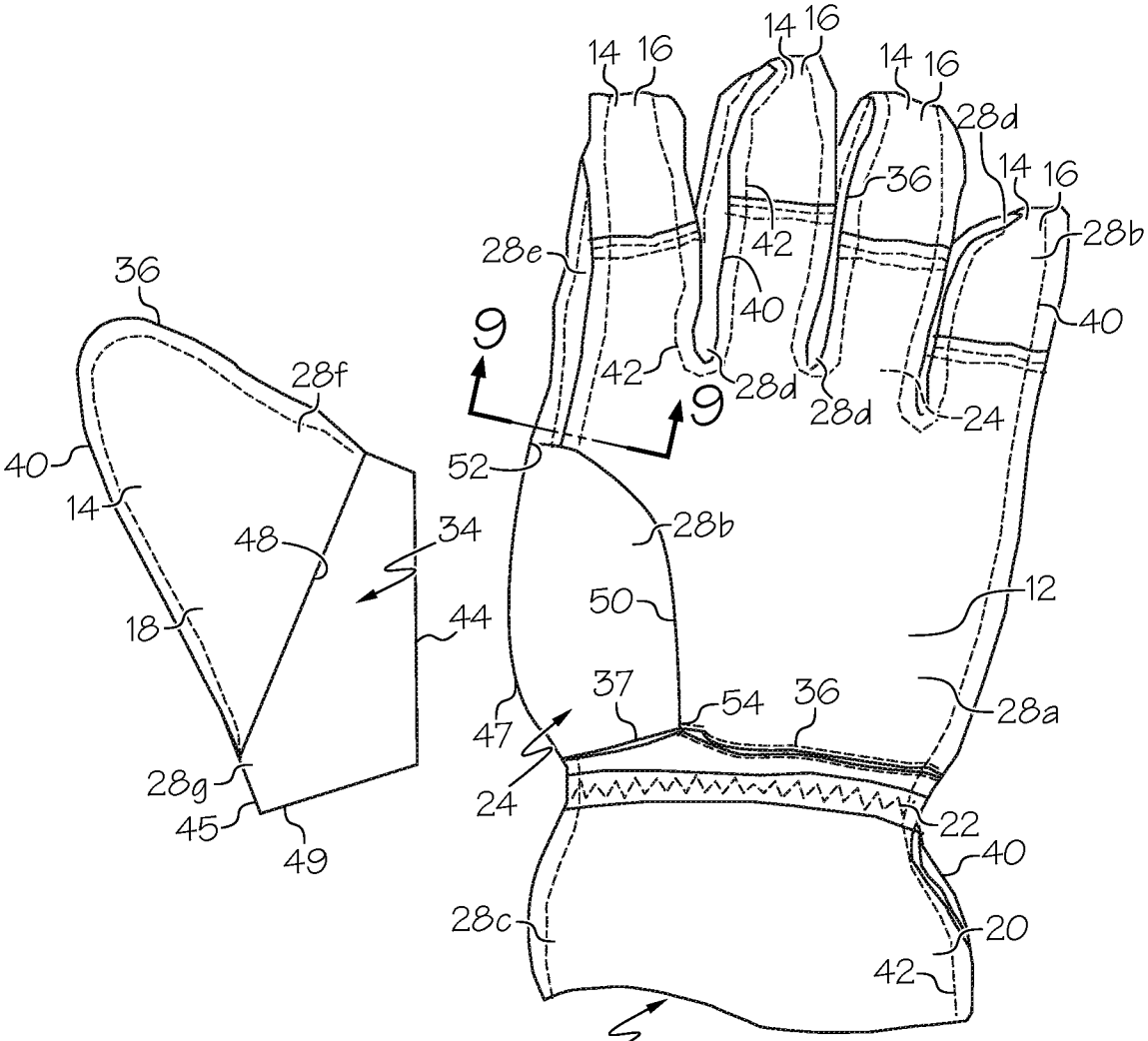
FIG. 8 shows the components of FIG. 7 partially assembled.

The wrist piece 28*c* is then attached to the backing piece 28*b* and palm piece 28*a*. The two thumb pieces 28*f*, 28*g* can then be coupled together to form the thumb 18, with a thumb cavity 34 positioned between the thumb pieces 28*f*, 28*g*. As can be seen in FIGS. 7 and 8, the thumb piece 28*g* can have a larger surface area than the thumb piece 28*f*, leaving part of the thumb piece 28*g* uncovered/exposed when the thumb 18 is initially formed.

Figure 9:
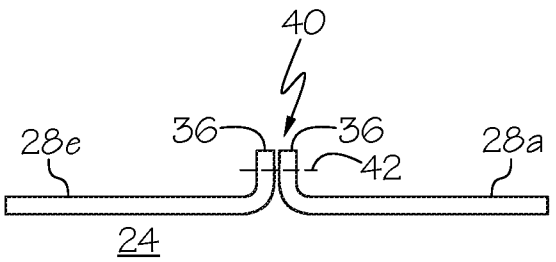
FIG. 9 is a cross sectional view along line 9-9 of FIG. 8.
Figure 10:
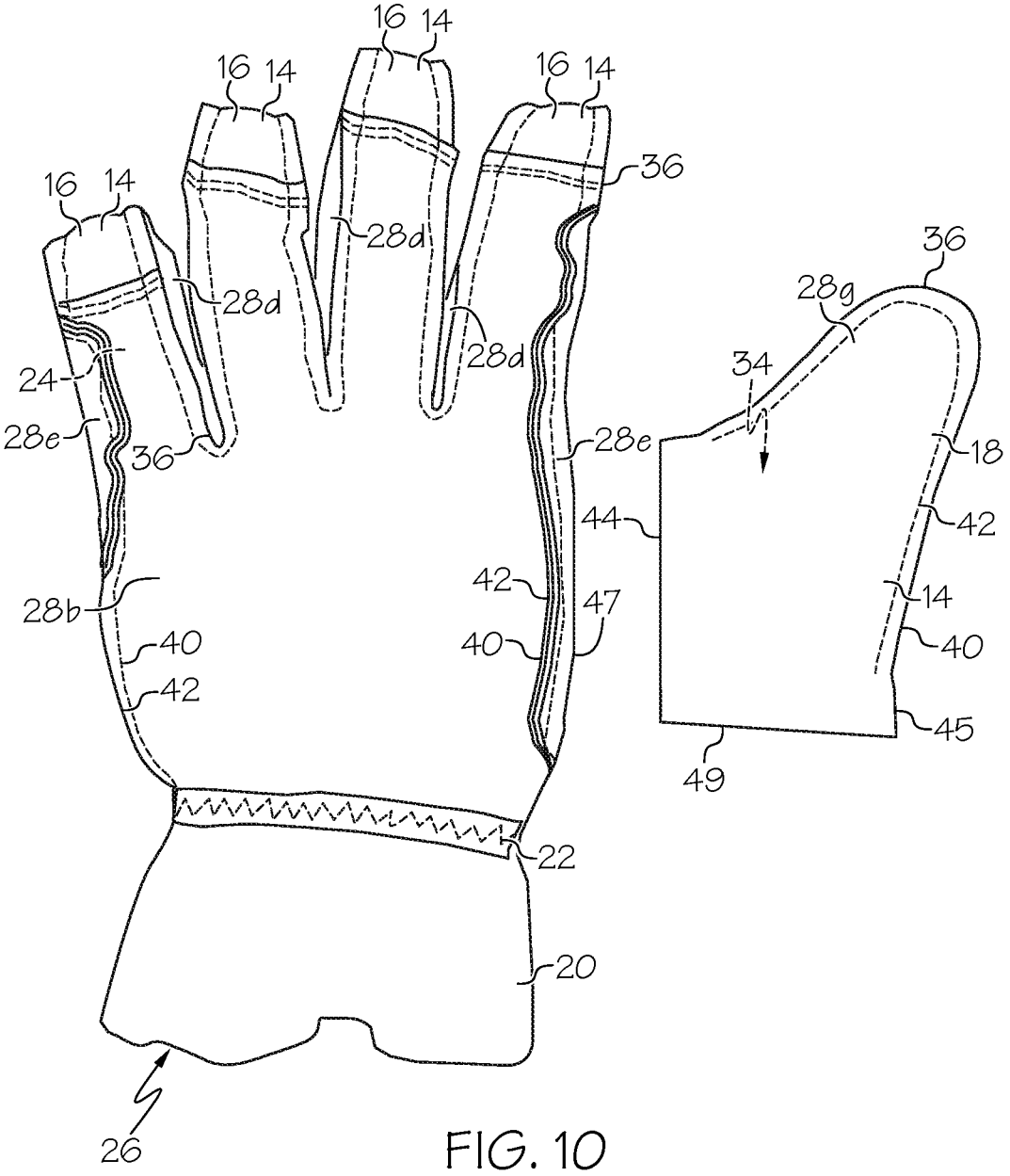
FIG. 10 is a back view of the components of FIG. 8.

After the pieces 28 are joined as described above, the partially assembled/manufactured glove as shown in FIGS. 8-10 may result. At this stage of assembly/manufacture, each piece of material 28 can be joined to another, adjacent piece (or pieces) of material 28 along a seam 40. Each piece of material 28 can include an outer edge or edges 36, and in order to form a seam 40 the outer edges 36 of two pieces of material 28 can be positioned adjacent to each other and folded up (positioned outwardly of and/or away from the inner cavity 24, as shown in FIG. 9) to form an area of facial contact between the pieces of material 28. The portions of the outer edges 36 in facial contact are oriented generally perpendicular to a remainder of the piece 28 and can then be joined/coupled, such as for example by a joining material 42 such as stitching extending through the outer edges 36 and/or an adhesive and/or use of a sonically bonding material.

In one case, the joined outer perimeters of the thumb pieces 28*f*, 28*g* shown in FIGS. 8 and 10 are formed in the manner shown in FIG. 9. Alternatively, the seams 40 can be formed simply by directly stitching through adjacent pieces of material 28 in a direction perpendicular to the pieces of material 28, without first folding up the outer edges 36. In this case, since the outer edges of the pieces of material 28 are exposed, such a seam can be considered an external seam when formed, and an internal seam if such a seam (and/or the associated glove or glove portion) is inverted. It should be noted that all areas where adjacent pieces of material 28 are joined, can be joined by seams 40, and thus for ease of illustration not all seams 40 are labelled in the drawings.

Figure 11:
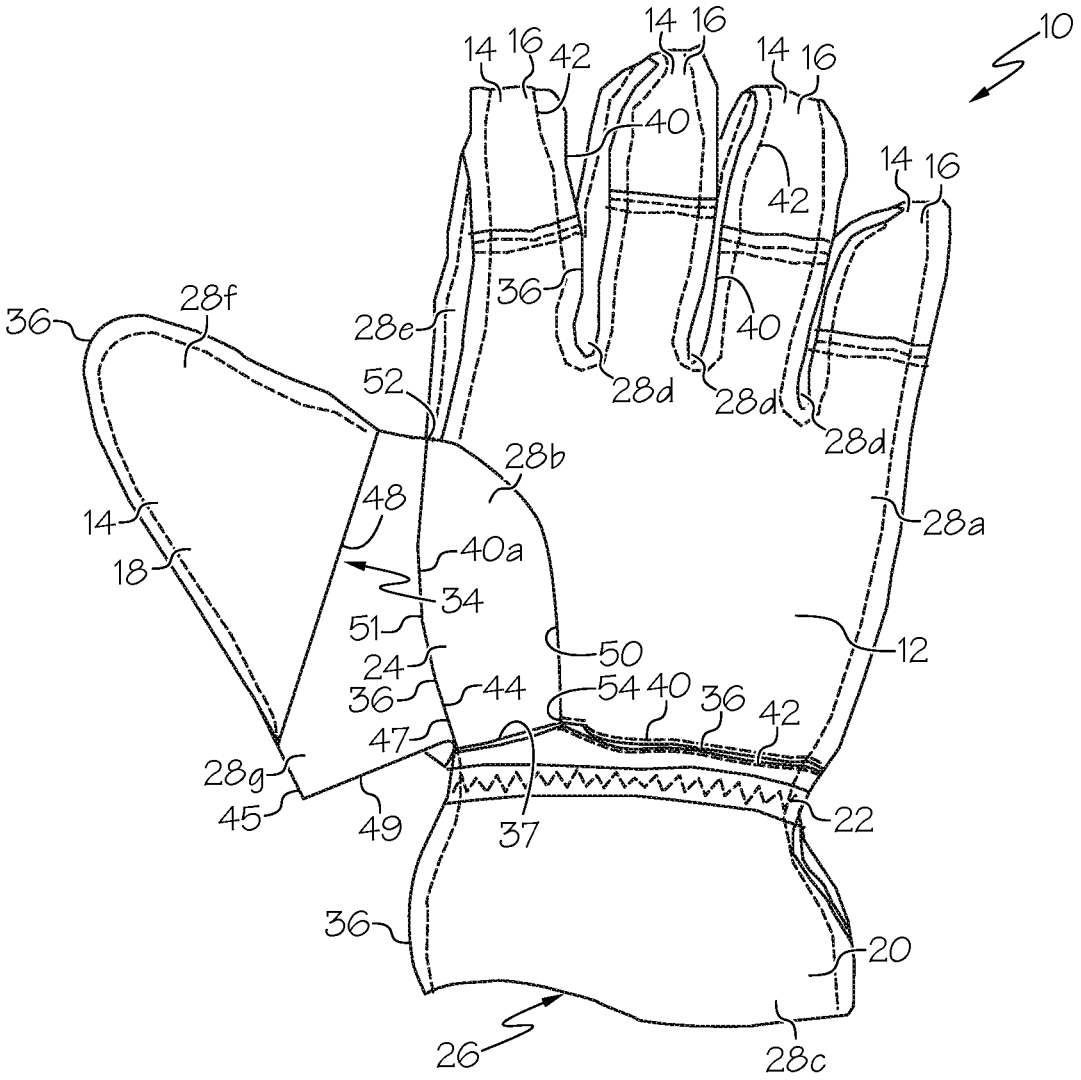
FIG. 11 shows the components of FIG. 8, with the thumb partially attached to the body of the glove.
Figure 12:
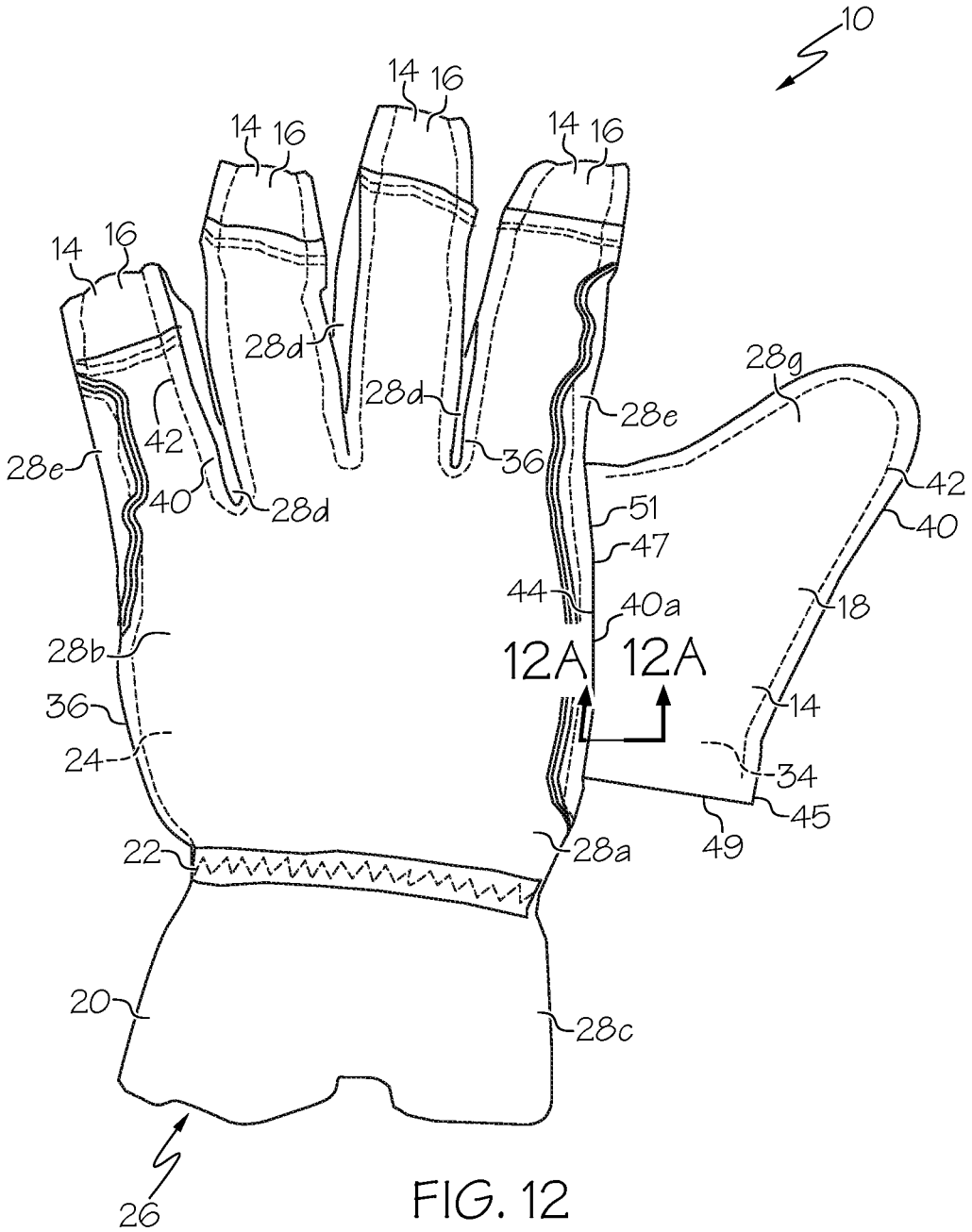
FIG. 12 is a back view of the partially assembled glove of FIG. 11.
Figure 13:
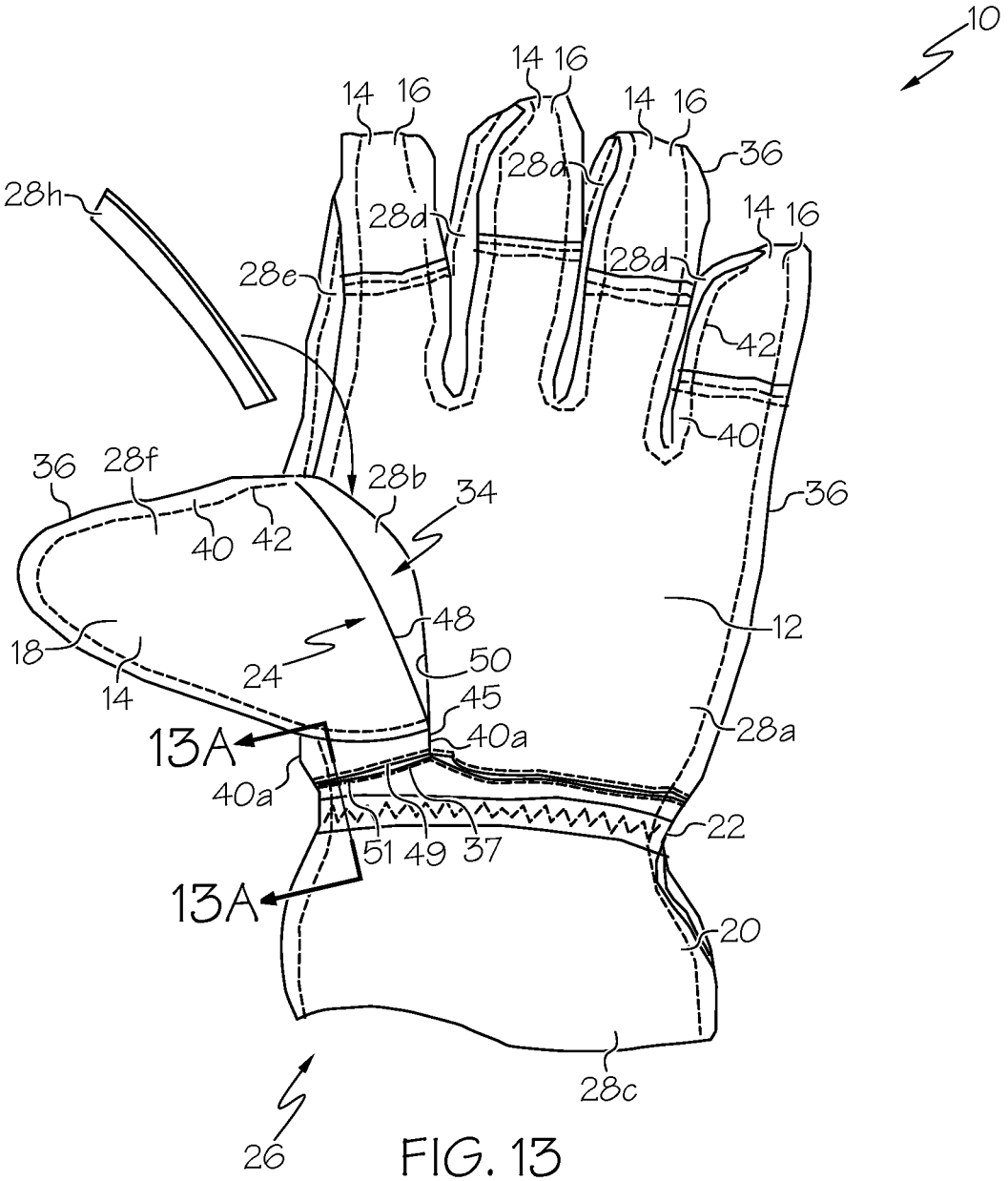
FIG. 13 shows the partially assembled glove of FIG. 11, with the thumb more fully attached.

As shown in FIGS. 8 and 10, the thumb 18 may not be initially attached to a main body or a remainder of the glove 10. In order to attach the thumb 18, the first outer edge 44 of the thumb 18/piece of material 28*g* is attached to an outer edge 47 of the backing piece 28*b* and/or the associated side piece 28*e* (extending along or defining the index finger of the glove 10), as shown in FIGS. 11 and 12, to partially attach the thumb 18 along a thumb outer seam 40*a*. Part of the thumb outer seam 40*a* can extend along part of an outer edge of the glove 10 in front view, as shown in FIG. 1. Next, a second outer edge 49 of the thumb 18/piece of material 28*g* (oriented at an angle relative to the first outer edge 44) can be attached to an outer edge 37. The outer edge 37 can extend in a circumferential direction along the wrist, and be an outer edge of the wrist piece 28*c* (FIGS. 8 and 13) to also form part of the thumb outer seam 40*a* (see FIG. 13A). Finally a third outer edge 45 of the thumb 18/piece of material 28*g* (oriented at an angle relative to the second outer edge 49, and not overlapped by the piece 28*f*) can be attached to a lower edge of the thumb seam edge 50 of the palm piece 28*a*, as shown in FIG. 13 to form part of the thumb outer seam 40*a*. Notably however, the lower edge 48 piece of thumb 18/piece of material 28*f* can remain unattached at this stage of assembly/manufacture.

Figure 12A:
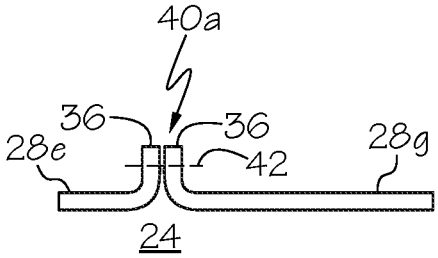
FIG. 12A is a cross sectional view along line 12A-12A of FIG. 12.
Figure 13A:
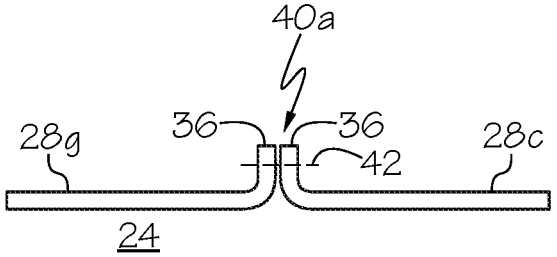
FIG. 13A is a cross sectional view along line 13A-13A of FIG. 13.

The seams 40 at this stage are formed as "external" seams at the time of formation, including the thumb outer seam 40*a*, as shown in FIGS. 12A and 13A. However, at a later stage during the assembly/manufacturing process, as will be described in greater detail below, the partially-assembled/manufactured glove will be inverted or turned inside-out, and the seams 40 formed at that stage will then become internal seams in the finished product/glove 10. It is easier, quicker and more convenient to make externally-formed seams during assembly/manufacturing since it may be difficult to access to the inner sides of the pieces 28/glove 10, particularly as the glove 10 is progressively assembled/manufactured.

Figure 15:
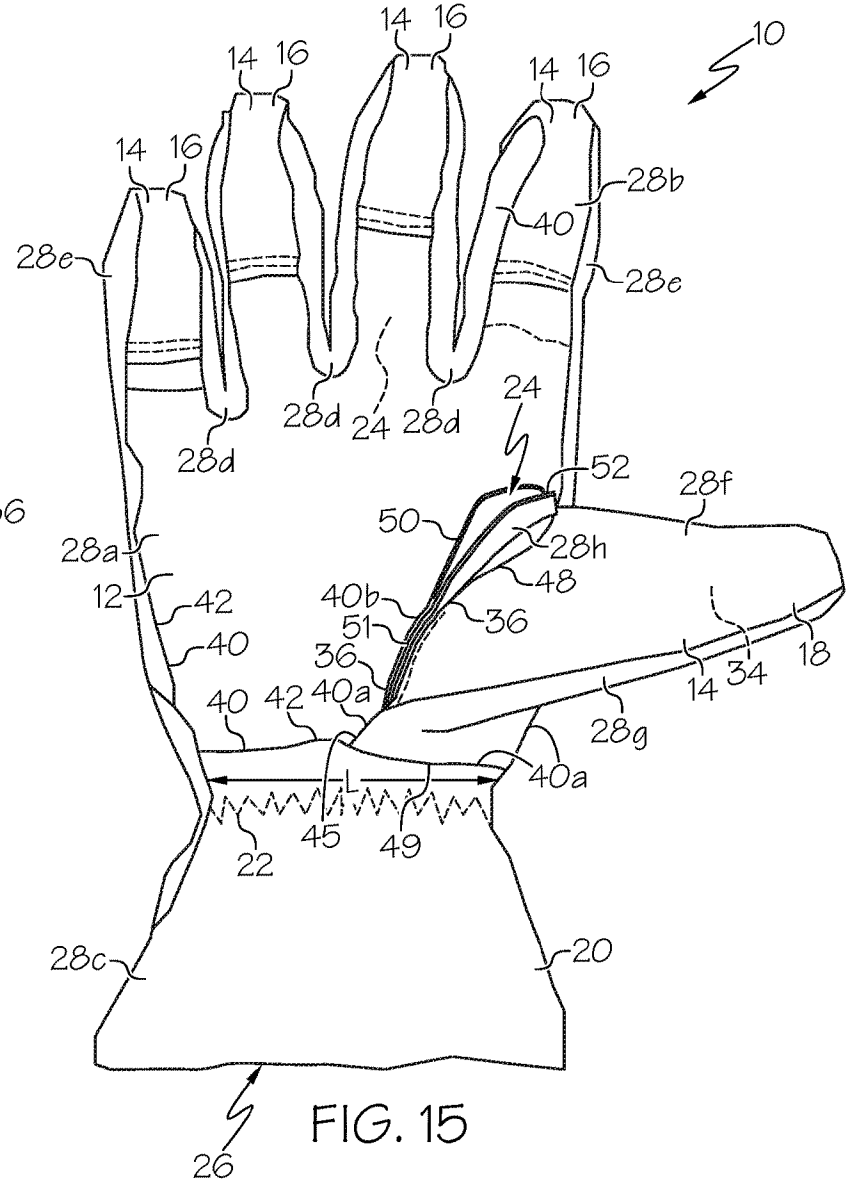
FIG. 15 shows the partially assembled glove of FIG. 13, with the palm thumb seam being formed.
Figure 14:
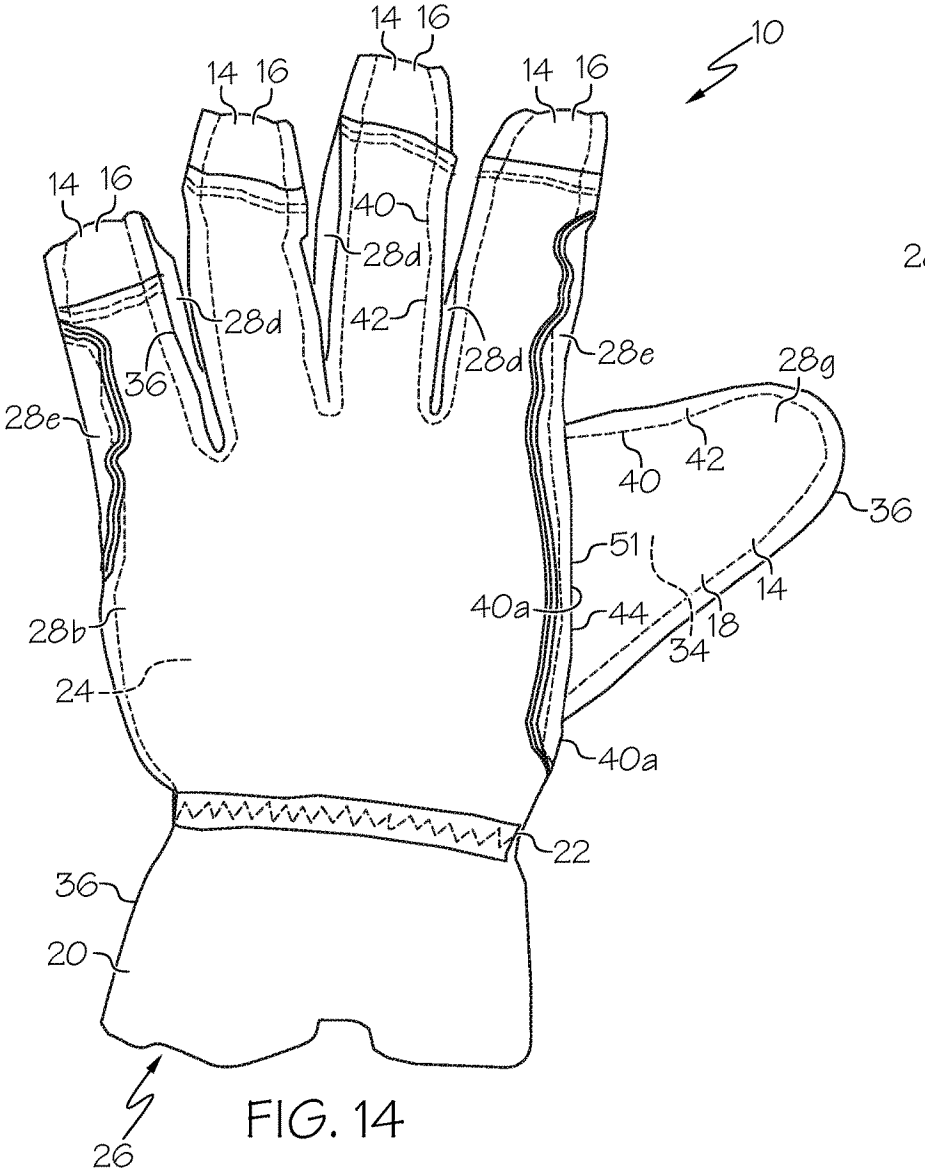
FIG. 14 is a back view of the partially assembled glove of FIG. 13.
Figure 16:
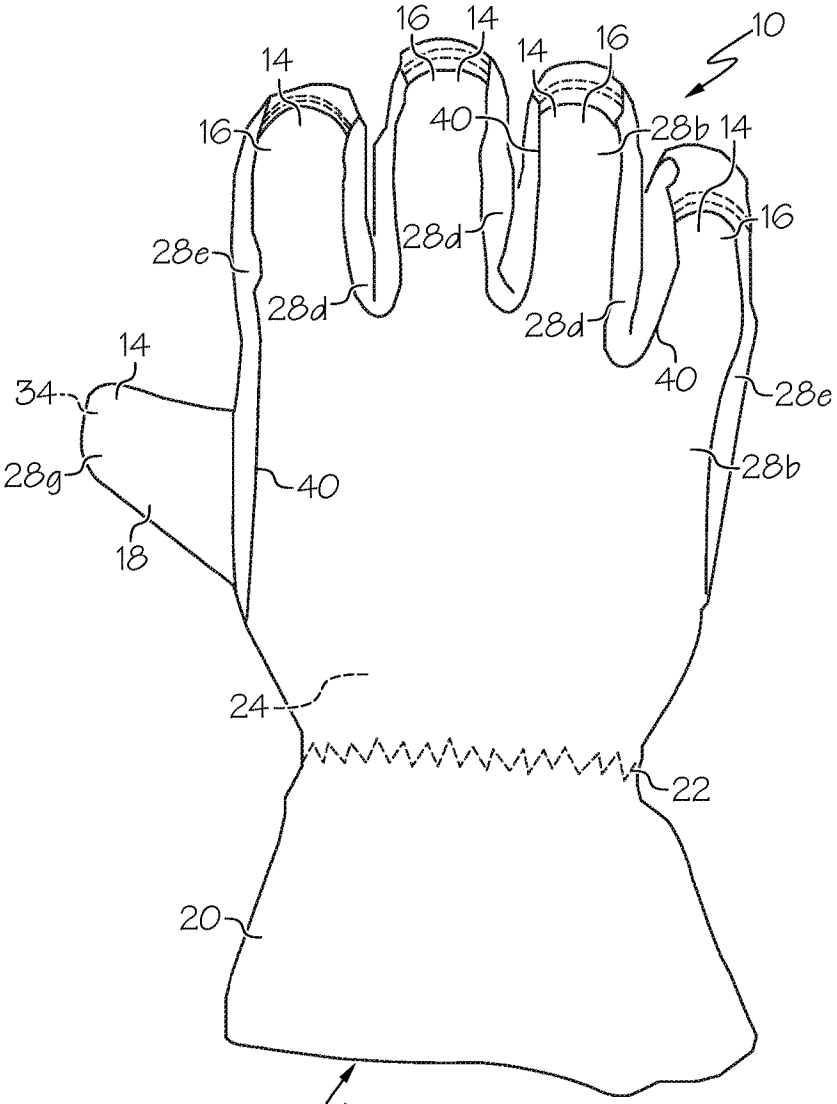
FIG. 16 is a back view of the partially assembled glove of FIG. 13 and the fully assembled glove of FIG. 2.

The partially assembled/manufactured glove of FIGS. 13 and 14 is then inverted/turned inside out to its final/use configuration, as shown in FIGS. 15 and 16. At this stage, the existing seams 40 (including the thumb outer seam 40*a*), initially formed as "external" seams, are converted into internal seams 40 for the final product.

The lower edge 48 of the thumb 18/piece of material 28*g* is then attached to a remainder/main body of the glove 10, such as by securing it to the thumb seam edge 50 of the palm piece 28*a* to form a thumb seam or thumb palm seam 40*b* extending along or through the palm 12 of the glove 10. In order to form the thumb palm seam 40*b* the edges 50, 48 of two pieces of material 28*a*, 28*f* can be positioned adjacent to each other and folded up (out and/or positioned away from the inner cavity 24; see FIG. 4) to form an area of facial contact between the pieces of material 28*a*, 28*f*. The portions of the pieces 28*a*, 28*f* in facial contact can be joined/coupled, such as for example by a joining material 42 such as stitching extending entirely through the pieces 28*a*, 28*f*. Alternatively, the thumb seam 40*b* can be formed simply by directly stitching through adjacent pieces of material 28*a*, 28*f* in a direction perpendicular to the pieces of material 28, without first folding up the outer edges 36. The thumb palm seam 40*b* can be formed as shown in FIG. 15, and the finished glove 10 product is shown in FIGS. 1 and 2 (and also FIG. 16). The thumb palm seam 40*b* can have a length of at least about one inch in one case, and at least about two inches in another case, to provide the comfort and other advantages described herein.

The thumb 18 can thus be attached to the remainder/body of the glove 10 by a thumb component seam 51 including the thumb outer seam 40*a* and the thumb palm seam 40*b*. The thumb palm seam 40*b* and thumb outer seam 40*a* (together, the thumb component seam 51) thus together extend entirely circumferentially around a base of the thumb 18 to join the thumb 18 to the remainder/body of the glove 10. The thumb outer seam 40*a* can attach the thumb piece 28*g* along edges 37, 50 and 45, all of which are internal seams (in the final product) in the illustrated embodiment. Alternatively, the thumb outer seam 40*a* can be those portions of the thumb component seam 41 that are not the thumb palm seam 40*b*. The thumb palm seam 40*b* is an external seam (in the final product) in the illustrated embodiment.

The thumb palm seam 40*b* can be positioned on the inner surface of the glove 10 (e.g. spaced away from the outer edges of the glove 10 when the glove 10 is viewed from the front as shown in FIG. 2), and more particularly on, extending across, extending partially across or position adjacent to the palm 12 of the glove 10. The thumb palm seam 40*b* can extend from a first position 52, located at an upper end of a base of the thumb 18 and below an index finger of the glove 10, to second position 54, located at a lower end of the base of the thumb 18 adjacent to the wrist 20 of the glove 10. In the illustrated embodiment the second position 54 is located more toward a center of the glove 10/palm 12 in a lateral (left-to-right) direction, in a front view of the glove 10, as compared to the first position 52. In some cases the thumb palm seam 40*b* may extend down to the wrist piece 28*c*, and the (internal) seam extending along the edge 45 can be omitted/replaced by the (external) thumb palm seam 40*b*.

The thumb palm seam 40*b* can be configured to be generally aligned with the line/joint 56 (e.g. the thenar crease or "life line") of the hand 62 of a wearer (see FIG. 17), located between a thumb pad 58 (e.g. the thenar) and a palm 60 (or remainder of the palm) of hand 62 of a wearer wearing the glove 10. In addition, the thumb palm seam 40*b* can be generally curved or arcuate (concave facing the outer edge of the glove 10) along an entirety or a majority of its length to match the shape of the thenar crease 56 of a wearer. In this manner, when a wearer flexes or moves his or her thumb along the thenar crease 56, the thumb palm seam 40*b* provides a natural hinge or pivot line about which the glove 10 is folded. More particularly, FIG. 1 shows the thumb 18 in an inner position, and FIG. 2 shows the thumb 18 in an outer position, and the thumb 18 can at least partially pivot about the thumb palm seam 40*b* when moving/pivoting between the inner and outer positions. Providing the thumb palm seam 40*b* as a pivot line avoids bunching of the glove 10 when the thumb 18 is folded, which provides ease of movement and greater range of motion for the wearer, and also avoids creasing of the material of the glove 10 which can lead to cracking or uneven wear.

Thus, some of the seams 40 of the glove 10 can be internal seams, and some of the seams 40 can be external seams. In the illustrated embodiment the thumb palm seam 40*b* is an external seam 40 (or is not an internal seam) and all other seams 40 (including a remainder of a thumb component seam 51; e.g. the thumb outer seam 40*a*) are internal seams (or are not external seams), but this can be varied as desired.

Figure 3:
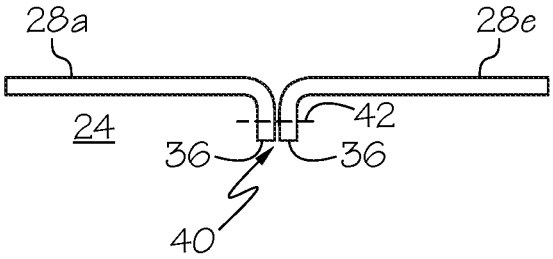
FIG. 3 is a cross sectional view along line 3-3 of FIG. 2.
Figure 4:
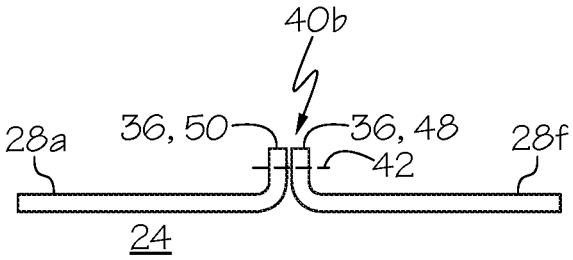
FIG. 4 is first embodiment of a cross sectional view along line 4-4 of FIG. 2.
Figure 4A:
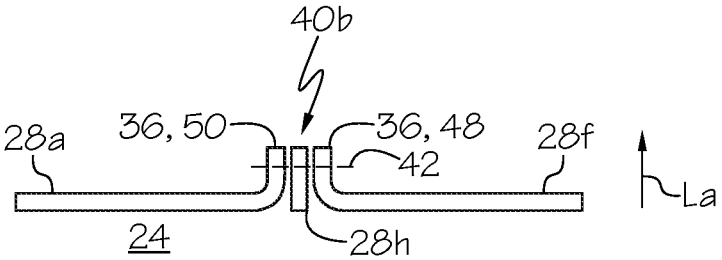
FIG. 4A is second embodiment of a cross sectional view along line 4-4 of FIG. 2.
Figure 6:
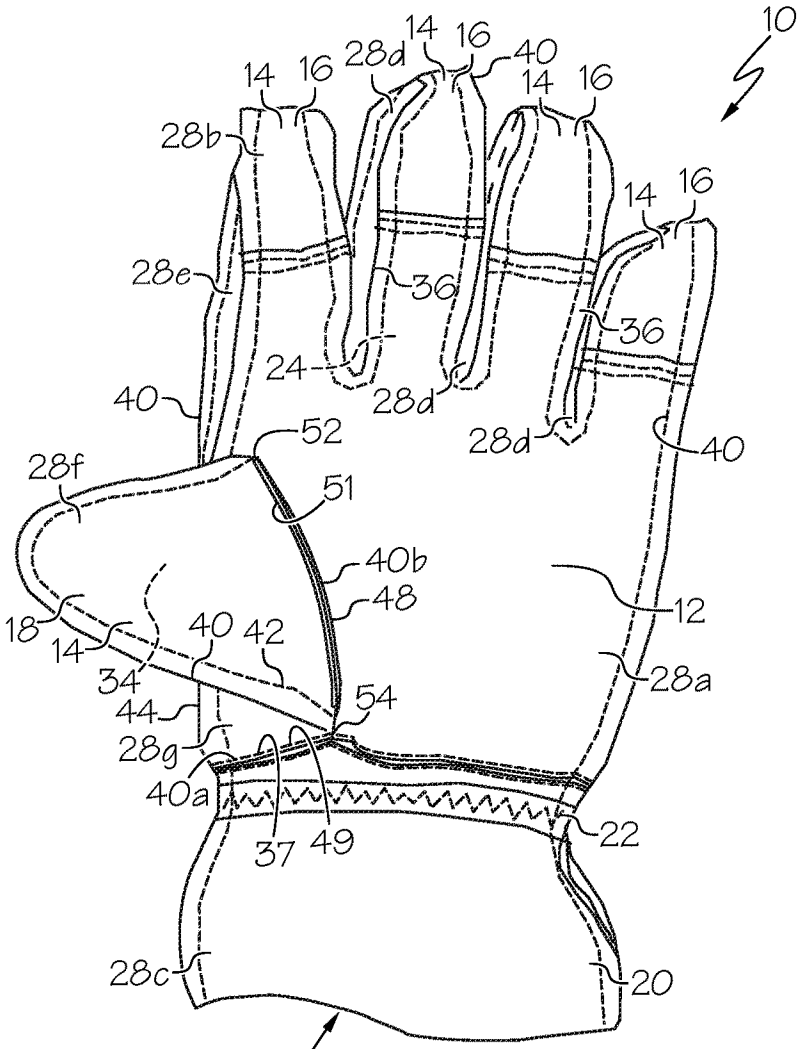
FIG. 6 is a front view of the glove of FIG. 5, with the thumb in an outer position.
Figure 5:
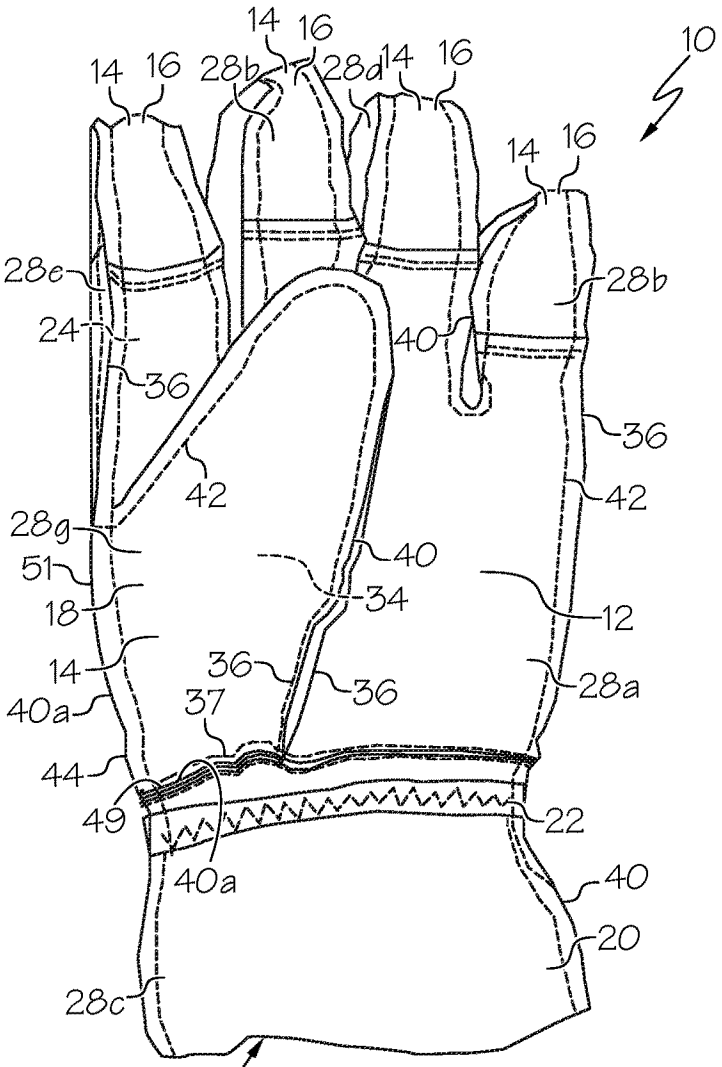
FIG. 5 is a front view of the glove of FIG. 1, turned inside-out to show various internal details.

For the internal seams 40, in one case the outer edges 36 of the pieces of material 28 extend downwardly/inwardly, as shown in FIG. 3, such that the outer edges 36 (and joining material 42) are positioned inside the inner cavity 24 and/or not visible or accessible from outside the glove 10. For the external seams, in one case the outer edges 36 of the pieces of material 28 extend upwardly/outwardly, as shown in FIG. 4 or 4A, such that the outer edges 36 (and joining material 42) are positioned outside of or externally of the inner cavity 24 and/or are visible or accessible from outside the glove 10. In one case, for an external seam, both edges of the joined pieces 28 are externally positioned (relative to the cavity 24), although in another case at least one edge of the joined pieces 28 can be externally positioned.

As outlined above the internal seams can initially be formed as external seams and are then converted into internal seams when the glove 10 is inverted. Conversely the external seam(s) (e.g. the thumb palm seam 40*b* in one case) is formed as an external seam and remains as an external seam in the finished glove 10. This method of assembly/manufacture enables both internal and external seams to be formed solely as externally-formed seams at the time of initial forming, by inverting the glove 10 at the appropriate time during the assembly/manufacturing process.

Internal seams 40 are generally less unsightly, less prone to fraying, and/or less prone to becoming worn or dirty. However internal seams 40 can present a relatively rough and sharp surface to the wearer, since the exposed edges 36 face internally toward a wearer's hand 62. This can be particularly true for a thumb palm seam, since the thumb palm seam can press against the palm of a wearer which can be a relatively sensitive area of the hand 62. In addition, any items which are gripped by the wearer of the glove 10 can press the thumb palm seam into the wearer's palm/hand. Finally if a wearer is required to place significant weight on the thumb palm seam, such as when the wearer is crawling on all fours, the wearer's weight can press his or her hand into the thumb palm seam.

Accordingly, as outlined above in one case the thumb palm seam 40*b* of the glove 10 is an external seam instead of an internal seam. Making the thumb palm seam 40*b* an external seam can increase the comfort to the wearer and enable the wearer to tightly grip items, crawl, and carry out other activities with increased comfort. In one case all other seams 40 of the glove 10 (including the thumb outer seam 40*a*), except the thumb palm seam 40*b*, are internal seams (or are not external seams), to provide the advantages of internal seams as outlined above, where the particular considerations of thumb palm seam 40*b* do not apply and/or apply to a lesser extent. In one case, a majority of the seams 40 of the glove 10, as measured along their length L (e.g. see FIG. 15 illustrating the length L direction for a seam 40 joining the palm piece 28*a* and the wrist piece 28*c*) are internal seams (or are not external seams). In another case, at least about 90% of the seams 40, as measured along their length L, are internal seams (or are not external seams) to provide the benefits outlined above, where selected seams are external seams (or are not internal seams) due to considerations as outlined above.

In one embodiment, as shown in FIG. 13, the thumb palm seam 40*b* includes a piece of reinforcing material 28*h* positioned between the facial edges of the adjacent pieces of material 28*a*, 28*f* The reinforcing material 28*h* can be positioned as shown either prior to inversion of the glove (FIG. 13 or 14) or after inversion (FIGS. 15 and 16). The reinforcing material 28*h* can be a relatively long, narrow sliver of material as shown in FIG. 13 and provides additional material/bulk to support the joining pieces 28*a*, 28*f* FIG. 4A shows a cross section taken along line 4-4 of FIG. 2, when the thumb palm seam 40*b* includes the reinforcing material 28*h*. When the joining material 42 is stitching, the stitching 42 can extend through the reinforcing material 28*h* (along with the outer edges 36 of the pieces 28*a*, 28*f*) which provides additional strength to the thumb palm seam 40*b* to prevent the stitching 42 from being pulled out in the lateral direction $L_a$.

As shown in FIG. 4A, the upper edge of the reinforcing material 28*f* (positioned externally of the inner cavity 24) can be generally aligned with the outer edges 36 of the glove 10/pieces of material 28*a*, 28*f* to provide a smooth profile, and the inner edge of the reinforcing material 28*h* (positioned inside the inner cavity 24) can be generally aligned with the inner surfaces of the adjacent pieces of material 28*a*, 28*f*, although the reinforcing material 28*h* can extend further than that shown in either or both directions if desired. It should also be noted that while FIG. 4A illustrates the reinforcing material 28*h* used with an external seam (the thumb palm seam 40*b*), the reinforcing material 28*h* could also be used with an internal seam 40, such as that of FIG. 3.

After the glove 10 of FIGS. 1 and 2 is formed, various other components and/or liners can be coupled thereto. For example, an inner glove liner (not shown), configured to be positioned between the glove 10 and the hand of a wearer and made of a lightweight fabric or other materials, can be positioned inside the glove 10. In addition various other components such as reinforcements or other layers or components (not shown) can be positioned on an outer surface of the glove 10.

The glove 10 and each layer of the glove 10 may meet the National Fire Protection Association ("NFPA") 1977 standards for firefighting gloves/garments/equipment ("Standards on Protective Clothing and Equipment for Wildland Fire Fighting"), which standards as of the filing date of this application are entirely incorporated by reference herein. The NFPA standards specify various minimum requirements for heat and flame resistance and tear strength. For example, in order to meet the NFPA standards, the glove 10 must be able to resist igniting, burning, melting, dripping, separation, and/or shrinking more than 10% in any direction after being exposed to a temperature of 500° F. for at least five minutes. Furthermore, in order to meet the NFPA standards, the combined layers of the glove 10 must provide a TPP rating of at least twenty.

Alternately or in addition to the NFPA Standard 1977, the glove 10 may meet standards of other countries or regions, including standards set by the International Organization for Standardization ("ISO"), in one case the following standard(s): Technical Committee ISO/TC94, Personal safety—Personal protective equipment, Subcommittee SC 14, Firefighters' personal equipment, ISO 16073-4, together with ISO 16073-1 to ISO 16073-7, and also one or more of ISO 139, ISO 3146:2000, ISO 3175-1, ISO 6330:2019, ISO 6942:2002, ISO 9151, ISO 12127-1, ISO 12947-4, ISO 14116:2015, ISO 15025, ISO 17493, ISO/TR 19591, ISO 21420:2019, ISO 23388:2018, ISO 11613, ISO/TS 11999-2, ISO 11999-4, ISO 13996, ISO 13997, ISO 15383, ISO 15384, ISO 15538, and ISO/TR 21808. The ISO standards for firefighter protective gloves, and those referenced above, in place as of the filing date of this application are entirely incorporated by reference herein.

Having described the invention in detail and by reference to certain embodiments, it will be apparent that modifications and variations thereof are possible without departing from the scope of the invention.

What is claimed is:

1. A glove comprising:

a plurality of pieces of material coupled together along a plurality of seams to form the glove, the glove including four fingers and a thumb, wherein a majority of said seams of the glove, as measured along their length, are not external seams, wherein a thumb seam extending along or through a palm of the glove is an external seam, wherein the thumb seam extends entirely through a thickness of two of the plurality of pieces of material joined by the thumb seam, wherein the thumb seam extends through a crotch of the glove located between a base of the thumb and a base of an index finger of the glove, where at least part of the crotch is located at an outer edge of the glove.

2. The glove of claim 1 wherein the majority of the seams of the glove, as measured along their length, are internal seams.

3. The glove of claim 1 wherein all of the seams of the glove, except the thumb seam, are not external seams.

4. The glove of claim 1 wherein the thumb seam extends from a first position, located at an upper end of a base of the thumb of the glove and below the index finger of the glove, to a second position, located at a lower end of the base of the thumb, at or adjacent to a wrist of the glove.

5. The glove of claim 4 wherein the second position is positioned closer to a center of the glove in a lateral direction than the first position.

6. The glove of claim 1 wherein the thumb seam is generally curved or arcuate along a majority of its length.

7. The glove of claim 1 wherein the thumb seam is configured to be generally aligned with a thenar crease of a hand of a wearer wearing the glove.

8. The glove of claim 1 wherein each seam of said plurality of seams is formed by two adjacent pieces of material coupled together at or adjacent to their outer edges thereof by at least one of stitching or adhesive.

9. The glove of claim 8 wherein the outer edges of the two adjacent pieces of material for each seam that is not an external seam are positioned within an inner cavity of the glove to thereby form an internal seam, and wherein the outer edges of the two adjacent pieces of material for the thumb seam are positioned externally of the inner cavity.

10. The glove of claim 1 wherein the thumb of the glove is attached to a body of the glove by the thumb seam and by a thumb outer seam which is an internal seam.

11. The glove of claim 1 wherein the thumb seam is formed by two adjacent pieces of material coupled together at or adjacent to their outer edges thereof, wherein the thumb seam includes a piece of reinforcing material positioned between the two adjacent pieces of material.

12. The glove of claim 11 wherein an upper edge of the reinforcing material is generally aligned with the outer edges of the two adjacent pieces of material.

13. The glove of claim 1 further comprising an inner glove liner configured to be positioned between the glove and a hand of a wearer, and wherein the glove further includes reinforcements positioned on an outer surface of the glove.

14. The glove of claim 1 wherein the thumb seam is defined by two pieces of material joined together at the thumb seam, and wherein outer edges of both pieces of material at the thumb seam are positioned outside an inner cavity of the glove.

15. The glove of claim 1 wherein the thumb seam is defined by two pieces of material joined together at the thumb seam, and wherein an outer edge of at least one of the pieces of material at the thumb seam is externally positioned.

16. The glove claim 1 wherein the thumb seam is a stitching seam.

17. The glove of claim 1 wherein the glove has an inner cavity configured to receive a hand of a wearer therein, and wherein the thumb seam extends through a thickness of the glove into the inner cavity.

18. The glove of claim 1 wherein the plurality of seams extend along a length of both sides of each of the four fingers.

19. A glove comprising:

a plurality of pieces of material coupled together along a plurality of seams to form the glove having a body, wherein a majority of said seams of the glove, as measured along their length, are not external seams, wherein a thumb seam extending along or through a palm of the glove is an external seam, and wherein the thumb seam extends entirely through a thickness of two of the plurality of pieces of material joined by the thumb seam, wherein a thumb of the glove is attached to the body of the glove by the thumb seam and by a thumb outer seam which is an internal seam, and wherein the thumb seam and the thumb outer seam together extend entirely circumferentially around the thumb.

20. A glove comprising:

a plurality of pieces of material coupled together along a plurality of seams to form the glove having a body, wherein a majority of said seams of the glove, as measured along their length, are not external seams, wherein a thumb seam extending along or through a palm of the glove is an external seam, and wherein the thumb seam extends entirely through a thickness of two of the plurality of pieces of material joined by the thumb seam, wherein a thumb of the glove is attached to the body of the glove by the thumb seam and by a thumb outer seam which is an internal seam, and wherein at least part of the thumb outer seam extends along at least part of an outer edge of the glove.

21. A glove comprising:

a plurality of pieces of material coupled together along a plurality of seams to form the glove including four fingers, wherein a majority of the seams of the glove, as measured along their lengths, are not external seams, and wherein at least part of at least one seam is an external seam joining two of the plurality of pieces of material, wherein the at least one seam extends along, and couples, aligned outer edges of the two of the plurality of pieces of material, and wherein the at least one seam is located on or through a crotch of the glove.

22. The glove of claim 21 wherein at least 90% of the seams, as measured along their lengths, are not external seams.

23. The glove of claim 21 wherein the external seam is a thumb seam extending along or through a palm of the glove.

24. The glove of claim 21 wherein the plurality of seams extend along a length of both sides of each of the four fingers.

25. The glove of claim 21 wherein the glove includes a palm and a back, positioned opposite to the palm relative to a thickness of the glove.

26. The glove of claim 21 wherein the plurality of pieces of material include a palm piece, a backing piece, and a plurality of side finger pieces forming sides of at least one of the fingers of the glove, and wherein the plurality of seams join together the palm piece, the backing piece, and the plurality of side finger pieces.

27. The glove of claim 21 wherein the crotch of the glove is located between a base of a thumb and a base of an index finger of the glove, where at least part of the crotch is located at an outer edge of the glove.

28. A method for making a glove comprising:

accessing a plurality of pieces of material;

a first coupling step including coupling at least two of the plurality of pieces of material together by forming a first seam to form a partially assembled glove, wherein the first coupling step includes forming a plurality of fingers and at least partially coupling a thumb to the partially assembled glove;

inverting the partially assembled glove such that the first seam is converted to an internal seam; and after the inverting step, coupling the at least two of the plurality of pieces of material together in an second coupling step to form a second seam which is an external seam.

29. The method of claim 28 wherein the second coupling step includes coupling the at least two of the plurality of pieces of material together along their outer edges.

30. The method of claim 28 wherein the first coupling step includes only partially coupling the thumb to the partially assembled glove.

31. The method of claim 28 further comprising the step of, prior to partially coupling the thumb to the partially assembly glove, forming the thumb by attaching two thumb pieces of material together with a thumb cavity therebetween, wherein one of the thumb pieces of material is larger than the other thumb piece of material.

32. The method of claim 28 wherein the second seam is a thumb seam extending at least one of along or through a palm of the glove.

* * * * *